US012446647B2

(12) United States Patent
Hermansen et al.

(10) Patent No.: US 12,446,647 B2
(45) Date of Patent: Oct. 21, 2025

(54) INCREMENTALLY ADJUSTABLE AND PIVOTABLE SEMI-RIGID RETENTION STRAP FOR A HELMET

(71) Applicant: DoubleThree, LLC, Laguna Beach, CA (US)

(72) Inventors: Frank Hermansen, Corona del Mar, CA (US); Carl Winefordner, Laguna Beach, CA (US)

(73) Assignee: DoubleThree, LLC, Laguna Beach, CA (US)

( * ) Notice: Subject to any disclaimer, the term of this patent is extended or adjusted under 35 U.S.C. 154(b) by 126 days.

(21) Appl. No.: 18/249,712

(22) PCT Filed: Aug. 19, 2021

(86) PCT No.: PCT/US2021/046763

§ 371 (c)(1),
(2) Date: Apr. 19, 2023

(87) PCT Pub. No.: WO2022/086619

PCT Pub. Date: Apr. 28, 2022

(65) Prior Publication Data

US 2023/0371641 A1 Nov. 23, 2023

Related U.S. Application Data

(63) Continuation of application No. 17/079,305, filed on Oct. 23, 2020, now Pat. No. 11,089,831.

(51) Int. Cl.
*A42B 3/08* (2006.01)

(52) U.S. Cl.
CPC ..... *A42B 3/08* (2013.01); *A42B 3/085* (2013.01)

(58) Field of Classification Search
CPC ..... A42B 3/08; A42B 3/03; A42B 3/00
(Continued)

(56) References Cited

U.S. PATENT DOCUMENTS 1,251,959 A 1/1918 Brodie
2,205,741 A 6/1940 Bowers
(Continued)

FOREIGN PATENT DOCUMENTS

CN 202819772 U 3/2013
CN 111631481 A 9/2020
(Continued)

OTHER PUBLICATIONS

Patent Cooperation Treaty, International Search Report and Written Opinion for International Application No. PCT/US2024/020445, Jul. 29, 2024, 13 pages.
(Continued)

*Primary Examiner* — Timothy K Trieu
(74) *Attorney, Agent, or Firm* — Stetina Garred Brucker & Newboles

(57) ABSTRACT

A helmet includes a shell having a front portion, a crown portion, and a rear portion. The helmet additionally includes a chin strap having a first attachment body and a second attachment body defining a strap length therebetween, with the chin strap being configured to allow for selective adjustment of the strap length. The first attachment body and the second attachment body are each pivotally connected to the shell such that the chin strap is selectively pivotable relative to the shell between a stored position and a deployed position. The chin strap moves toward the front portion of the shell as the chin strap pivots from the deployed position toward the stored position. At least a portion of the chin strap is semi-rigid so as to be disposable in tension and compression without changing shape.

14 Claims, 8 Drawing Sheets

(58) Field of Classification Search
USPC ..... 2/421
See application file for complete search history.

(56) References Cited

U.S. PATENT DOCUMENTS

| | | | | |
|---|---|---|---|---|
| 2,511,234 | A | 6/1950 | Anderson | |
| 2,926,406 | A | 3/1960 | Edwards et al. | |
| 3,041,622 | A | 7/1962 | Gurtowski | |
| 3,075,201 | A | 1/1963 | Lindblom | |
| 3,214,809 | A | 11/1965 | Edwards | |
| 3,325,824 | A | 6/1967 | Donegan | |
| 3,444,560 | A | 5/1969 | Northup, Jr. | |
| 3,478,365 | A | 11/1969 | Varga | |
| 3,572,329 | A | 3/1971 | Woskin | |
| 4,023,209 | A * | 5/1977 | Frieder, Jr. | A42B 3/166 2/6.2 |
| 4,398,306 | A * | 8/1983 | Gooding | A42B 3/16 24/265 R |
| 4,434,514 | A | 3/1984 | Sundahl et al. | |
| 4,641,382 | A | 2/1987 | Gessalin | |
| 4,885,806 | A | 12/1989 | Heller | |
| 4,888,831 | A | 12/1989 | Oleson | |
| 5,077,839 | A | 1/1992 | Keller | |
| 5,357,654 | A | 10/1994 | Hsing-Chi | |
| 5,571,220 | A | 11/1996 | Hall | |
| 5,915,538 | A | 6/1999 | Basson | |
| 5,950,245 | A | 9/1999 | Binduga | |
| 5,987,652 | A | 11/1999 | Fowler | |
| 6,708,376 | B1 | 3/2004 | Landry | |
| 7,114,197 | B2 | 10/2006 | Garneau et al. | |
| 7,707,695 | B2 | 5/2010 | Dubois | |
| 8,032,993 | B2 | 10/2011 | Musal | |
| 8,635,715 | B2 | 1/2014 | Hunt et al. | |
| 10,251,451 | B2 | 4/2019 | Converse et al. | |
| 10,485,282 | B2 | 11/2019 | Coursimault | |
| 11,089,831 | B1 | 8/2021 | Hermansen | |
| D982,835 | S | 4/2023 | Cao | |
| 2003/0106138 | A1 | 6/2003 | Guay | |
| 2009/0082835 | A1 | 3/2009 | Jaax | |
| 2009/0265841 | A1 | 10/2009 | Ferrara | |
| 2010/0170068 | A1 | 7/2010 | Musal | |
| 2010/0319109 | A1 | 12/2010 | Field | |
| 2011/0088148 | A1 | 4/2011 | Chen | |
| 2011/0113519 | A1 | 5/2011 | Gendron et al. | |
| 2011/0167543 | A1 * | 7/2011 | Kovacevich | F16G 11/12 2/417 |
| 2012/0204330 | A1 | 8/2012 | Albouy | |
| 2012/0251328 | A1 | 10/2012 | Connor | |
| 2012/0278976 | A1 | 11/2012 | Benton | |
| 2013/0031702 | A1 | 2/2013 | Gafforio | |
| 2015/0107006 | A1 | 4/2015 | Chen | |
| 2016/0270470 | A1 | 9/2016 | Hickman et al. | |
| 2017/0215512 | A1 | 8/2017 | Zhang | |
| 2017/0325534 | A1 | 11/2017 | Noordzij et al. | |
| 2018/0064197 | A1 | 3/2018 | Finquel et al. | |
| 2018/0092424 | A1 | 4/2018 | Hall | |
| 2019/0269193 | A1 | 9/2019 | Benyola | |
| 2019/0350296 | A1 | 11/2019 | Sanders | |
| 2021/0153594 | A1 | 5/2021 | Rogers | |

FOREIGN PATENT DOCUMENTS

| | | | |
|---|---|---|---|
| DE | 04444188 | A1 | 6/1996 |
| DE | 10040509 | C2 | 12/2003 |
| EP | 0270368 | A1 | 6/1988 |
| EP | 0558427 | A1 | 9/1993 |
| EP | 2123182 | A2 | 11/2009 |
| EP | 3094199 | B1 | 7/2019 |
| EP | 3373759 | B1 | 12/2019 |
| FR | 2831774 | A1 | 5/2003 |
| FR | 2838611 | A1 | 10/2003 |
| JP | 2003253519 | A | 9/2003 |
| JP | 2017160589 | A | 9/2017 |
| JP | 2017538052 | A | 12/2017 |
| KR | 101385672 | B1 | 4/2014 |
| KR | 10-2021-0150257 | A | 12/2021 |
| WO | 2011/051989 | A1 | 5/2011 |
| WO | WO2014163404 | | 10/2014 |

OTHER PUBLICATIONS

Patent Cooperation Treaty, International Search Report and Written Opinion for International Application No. PCT/US2021/046763, mailed Sep. 16, 2021, 10 pages.

European Patent Office, European search report for Application No. 21815090.2, Oct. 4, 2023, 23 pages.

Suga, Hitomi; Japanese Office Action; Japanese Patent Application No. 2023-524706; Dated Jan. 28, 2025; 5 pages.

* cited by examiner

INCREMENTALLY ADJUSTABLE AND PIVOTABLE SEMI-RIGID RETENTION STRAP FOR A HELMET

CROSS-REFERENCE TO RELATED APPLICATIONS

This application claims priority to PCT International Application No. PCT/US2021/046763 filed on Aug. 19, 2021, which application claims priority to U.S. patent application Ser. No. 17/079,305 filed on Oct. 23, 2020, now U.S. Pat. No. 11,089,831 issued on Aug. 17, 2021, the entire disclosures of which are expressly incorporated herein by reference.

STATEMENT RE: FEDERALLY SPONSORED RESEARCH/DEVELOPMENT

Not Applicable

BACKGROUND

1. Technical Field

The present disclosure generally relates to an improved retention system for a helmet. More specifically, the present disclosure is concerned with a semi-rigid micro-adjustable chin strap apparatus for a helmet, wherein the strap can pivot out of the way for storage and for installing and removing the helmet.

2. Description of the Related Art

Safety helmets are well known and may be worn when participating in a wide variety of activities, including but not limited to, many different areas of recreation, transportation, military, and construction. For example, helmets are typically worn for cycling, snowboarding and skiing, skateboarding, rock climbing, football, baseball, field hockey, ice hockey, horse riding, scooter and motorcycle riding, battle fields, and on construction sites, to name a few. One aspect that nearly every conventional helmet has in common is one or more flexible webbing straps that connect under the user's chin to help keep the helmet in place on the wearer's head.

Conventional safety helmets typically worn by users participating in activities requiring head protection, such as for example cyclists, may include a domed-shaped body in various sizes and shapes. Fastening chin straps may be required to retain the helmet more securely in position on the wearer's head. The chin straps may be flexible webbing and may include a buckle to form a helmet retention system which may be mounted to the helmet and extend under the chin of the helmet wearer during use. In many helmets, one strap may be connected to the helmet behind each of the user's ears and another strap may be connected to the helmet in front of each of the user's ears. On each side, these straps may be connected together to effectively form a single strap. The two single straps may be adjustable in length to achieve a tight fit under the user's chin.

Helmet chin straps assist in maintaining the helmet securely attached to the wearer's head. Indeed, not only do they minimize the occurrences of vertical movement of the helmet being projected off of the wearer's head, but they also generally help to minimize the occurrences where the helmet is pivoted off of or out of position on the front or rear portion of the wearer's head, exposing vulnerable parts of the user's head to impact.

These straps are typically difficult to adjust properly, and thus, many users wear helmets that are improperly adjusted, which may mitigate the effectiveness of the safety helmet. For example, it may be difficult to adjust the straps so that on a given side of the helmet, the straps are symmetrical from where the straps intersect under the user's ears. Further difficulty may be associated with adjusting the straps such that all of the straps are taut when the buckle is connected.

While conventional helmets may meet certain safety standards when the straps are adjusted correctly, very few users actually use their helmets in a correctly adjusted configuration. Also, all the adjustments are typically done when the helmet is off the user's head which may result in the process being completed by trial and error. Typically, even with several adjustment attempts, when the buckle is connected, at least one of the straps (e.g., in front of or in back of ears) will be loose, which could allow the helmet to become dislodged in the event of a crash. Furthermore, adjustment may be so cumbersome that few users are willing to adjust their chin strap to be as tight as it should be because a requisite level of tightness may not be comfortable and much of the time, the user may not be engaging in the most dangerous part of their activity which would require a tight strap. Therefore, most users end up wearing their helmet with the straps unevenly adjusted and adjusted too loose, even when they know they are about to engage in the most dangerous part of their activity. Undoubtedly, such improper fitting of conventional straps may cause a significant number of head trauma injuries, and in some cases, deaths.

Conventional helmet strap systems may include a headband strap system that runs around the forehead, side, and back of the head for securing the helmet and improving the overall fit on a wearer. However, in most cases, the portion of the retaining system that extends under the user's chin includes flexible webbing straps with a conventional buckle.

However, such fastening strap systems, particularly when not adjusted properly may not always prevent undesirable pivotal movement of the helmet toward the front or rear of the wearer's head since the position of the straps holding the helmet extends under the chin. This potential pivotal movement may result in exposing the back or front of the wearer's head, which may be hazardous especially during a multiple-impact fall.

For a helmet to properly protect a user's head, it is typically critical that the chin strap be properly adjusted. However, when properly adjusted, the snug chin strap may not be comfortable and so many users unbuckle their chin strap during times of use that are not as dangerous. For example, while riding a ski lift, a ski or snowboard helmet may not be necessary for safety and so many users will unbuckle their chin strap for the ski lift ride, and then buckle their chin strap prior to skiing. Understandably, users sometimes forget to buckle their straps, which is dangerous and could lead to their helmet falling off of their head.

Accordingly, there is a need in the art for a helmet retention system that is easy to adjust to a proper retention position, and may also be easily moved to a non-use position when not engaged in activities requiring protection of the helmet. Various aspects of the present disclosure address this particular need, as will be discussed in more detail below.

BRIEF SUMMARY

In accordance with one embodiment of the present disclosure, there is provided a helmet configured to be wearable on a head of a user. The helmet includes a shell having a front portion, a crown portion, and a rear portion. The helmet additionally includes a chin strap having a first attachment body and a second attachment body defining a strap length therebetween, with the chin strap being configured to allow for selective adjustment of the strap length. The first attachment body and the second attachment body are each pivotally connected to the shell such that the chin strap is selectively pivotable relative to the shell between a stored position and a deployed position. The chin strap moves toward the front portion of the shell as the chin strap pivots from the deployed position toward the stored position. At least a portion of the chin strap is semi-rigid so as to be disposable in tension and compression without changing shape.

The front portion of the helmet may define a recess and at least a portion of the chin strap may be received within the recess when the strap is in the stored position. The front portion may include a forward edge defining a forward-most plane and a lower-most plane. The rear portion of the helmet may define a rearward most plane. At least a portion of the strap may traverse the lower-most plane as the chin strap transitions from the deployed position to the stowed position, and at least a portion of the strap may reside between the forward-most plane and the lower-most plane when the chin strap is in the stored position.

The helmet may additionally include a shell magnet connected to the shell and a strap magnet connected to the strap, the shell magnet and the strap magnet being positioned and configured to effectuate magnetic coupling between the shell and the chin strap when the chin strap is in the stored position.

The shell and chin strap may be configured to effectuate frictional engagement between the shell and the chin strap to retain the chin strap in the stored position.

The chin strap may define a pivot angle relative to the shell as the chin strap pivots between the stored position and the deployed position. The pivot angle may be between 60-150 degrees, and more preferably between 80-130 degrees.

The chin strap may include a pair of end portions and a central portion. Each end portion may be angled relative to the central portion.

The shell may include a lower edge, at least a portion of which defines a contour that is complementary in shape to a contour of the chin strap.

The chin strap may include a pair of arms. The pair of arms may be moveable in a first direction away from each other to increase the strap length, and in an opposing second direction toward each other to decrease the strap length. The helmet may additionally include a dial in operative communication with the pair of arms. The dial may be rotatable relative to the pair of arms such that rotation of the dial in a first rotational direction causes the pair of arms to move away from each other, and rotation of the dial in a second rotational direction causes the pair of arms to move toward each other. Each of the pair of arms may include teeth that interface with the dial.

The shell may include a lower portion extending in spaced relation to the front portion to define an opening therebetween, with the opening being sized to allow a user to view therethrough when wearing the helmet.

The helmet may include a knob operatively coupled to the chin strap and rotatable relative to the shell. The knob may be configured such that rotation of the knob relative to the shell facilitates transition of the chin strap between the stored position and the deployed position.

The helmet may additionally include a pair of curved guides coupled to the shell in opposed relation to each other. The chin strap may include a pair of followers slidable along respective ones of the curved guides as the chin strap transitions between the stored position and the deployed position.

The shell may include an inner surface defining a cavity sized to receive at least a portion of the head of the user. The inner surface may include a forward-most point residing on a forward plane, a rearward-most point residing on a rear plane parallel to the forward plane, and an upper-most point residing on an upper plane perpendicular to both the forward and rear planes. The shell may be associated with a pivot zone having a center that is a first distance from the forward plane, a second distance from the rear plane, and a third distance from the upper plane, the first distance being 50-60% of the second distance, and the second distance being equal to the third distance. The pivot zone may be circular and have a diameter that is 80-90% of the first distance. At least a portion of the pivot zone may overlaps the shell.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a retention mechanism for a helmet and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Generally stated, the present disclosure relates to a helmet assembly having a pivoting retractable chin strap for easily and comfortably adjusting the fit of the chin strap and also enabling selective positioning of the chin strap between a deployed position and a storage position relative to a shell of the helmet assembly.

Figure 11:
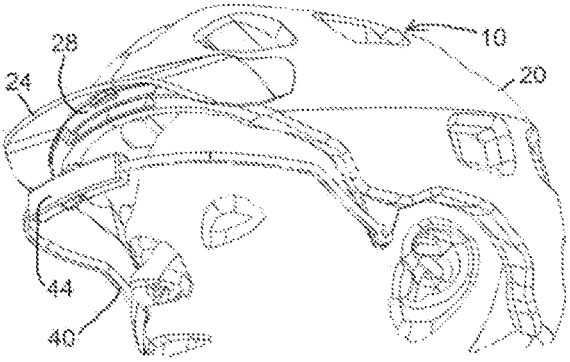
FIG. 11 is a perspective view of the helmet assembly shown in FIG. 2.

FIGS. 1-11 and 20-21 depict a first embodiment of helmet assembly 10 (e.g., helmet) configured to be wearable on a head of a user. The helmet assembly 10 generally comprises a helmet shell assembly 20 and a chin strap assembly 40 (e.g., chin strap). Helmet shell assembly 20 may include a shell 21 having an inner surface defining a cavity sized to receive at least a portion of the head of the user. The shell 21 may also include a front portion 23, a crown portion 25, and a rear portion 27. The front portion 23 may include a visor 24 defining a pocket recess 28 (FIG. 11). In more detail, the front portion 23 may include a forward edge 29, which may extend across the front of the shell 21. The forward edge 29, when viewed from the perspective shown in FIG. 1, may define a forward-most plane 31 (e.g., a vertical tangent to the forward edge 29) and a lower-most plane 33 (e.g., a horizontal tangent to the forward edge 29).

The pocket recess 28 may be bounded, at least partially, by the forward-most plane 31 and the lower-most plane 33. The importance of the pocket recess 28 will be explained in more detail below.

Chin strap assembly 40 may be comprised of arms 51 and 52, pivot ends 42*a* and 42*b* (e.g., first and second attachment bodies), a twist adjustment mechanism 44 with a twisting adjustment knob 46, and a pad 41. According to one embodiment, chin strap assembly 40 may be made predominantly out of injection molded Nylon or other equivalent materials known in the art in order to have strong tensile properties while being able to bend slightly when adjusted. In this regard, at least the arms 51, 52 may be disposable in both tension and compression, Thus, the arms 51, 52, differ from conventional woven chin straps, which are generally incapable of being disposed in compression.

Figure 1:
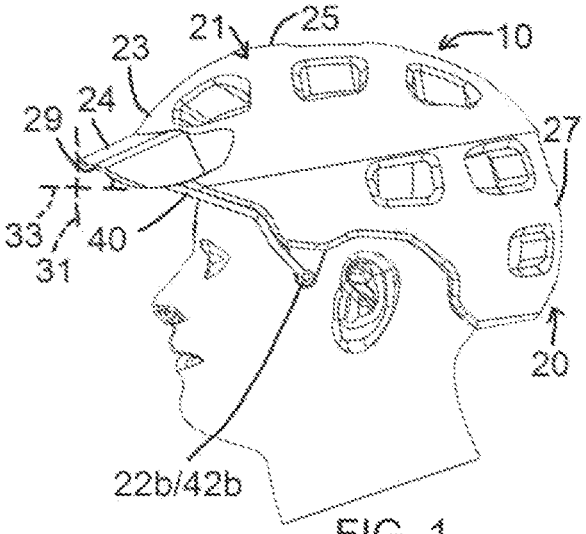
FIG. 1 is a side view of a preferred embodiment with a pivoting retractable chin strap in a stored position in a helmet assembly worn by a user.
Figure 2:
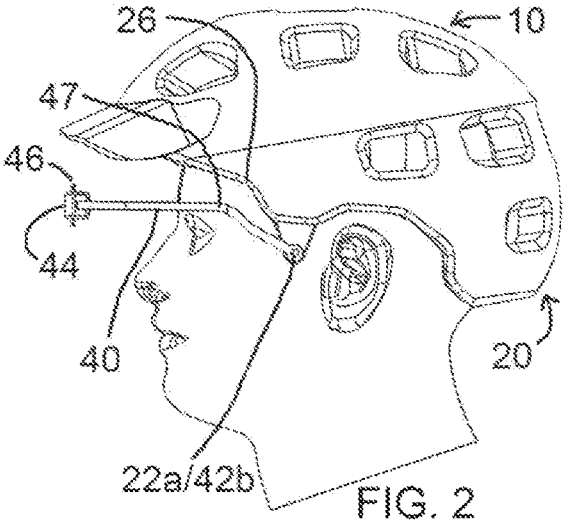
FIG. 2 is a side view of a pivoting retractable chin strap pivoted part way down in the helmet assembly shown in FIG. 1.
Figure 3:
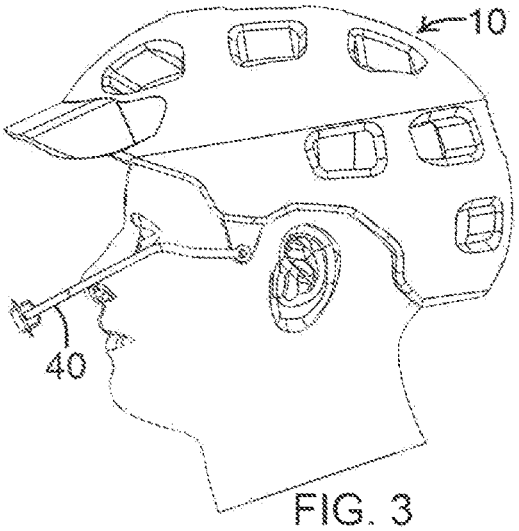
FIG. 3 is a side view of a pivoting retractable chin strap pivoted further down in a helmet assembly shown in FIG. 2.
Figure 4:
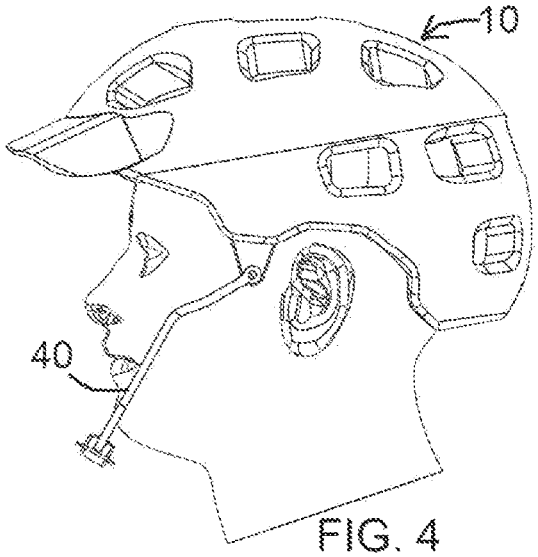
FIG. 4 is a side view of a pivoting retractable chin strap pivoted even further down in a helmet assembly shown in FIG. 3.
Figure 5:
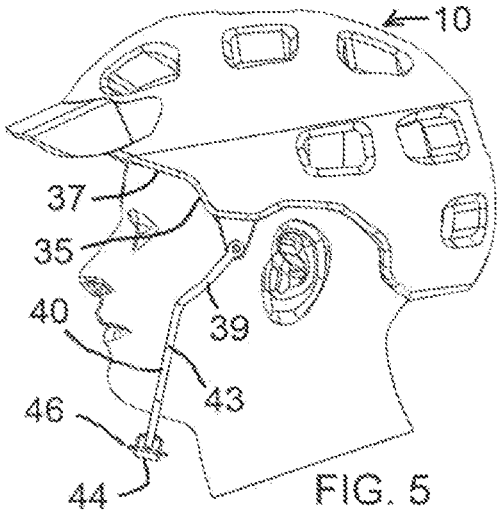
FIG. 5 is a side view of a pivoting retractable chin strap pivoted all the way down under user's chin and ready for retraction in a helmet assembly shown in FIG. 1.

FIG. 1 shows the user wearing preferred embodiment 10 with chin strap assembly 40 in a stored position, with the twist adjustment mechanism 44 and twisting adjustment knob 46 located within pocket recess 28. When the chin strap 40 is in the stored position, the chin strap 40 may be substantially concealed or out of the user's field of view. Furthermore, concealing or hiding the chin strap 40 may create an aesthetically preferred appearance for the user. Light friction between the chin strap assembly 40 and the shell assembly 20 may keep chin strap assembly 40 in its stored position relative to the helmet shell assembly 20. For instance, the twist adjustment mechanism 44 and/or knob 46 may contact the visor 24 or other portion of the shell 21, and such contact may retain the chin strap assembly 40 in the stored position. While chin strap assembly 40 is in the stored position, the chin strap assembly 40 is removed from under the wearer's chin to allow the user to easily put on and take off helmet 10 without interference.

FIGS. 2-5 show chin strap assembly 40 being sequentially pivoted down from the stored position to a deployed position (e.g., an under the chin position). Note that because of the location of the attachment point of pivot ends 42*a*, 42*b* to the shell assembly 20, twist adjustment mechanism 44 may pivot between the stored position to the deployed position (e.g., under the user's chin) without colliding with the user's nose, chin, or any other part of the user's face.

According to one embodiment, as the chin strap 40 transitions from the stored position toward the deployed position, at least a portion of the chin strap 40 traverses the lower-most plane 33 defined by the front portion 23. In particular, the twist adjustment mechanism 44 passes from above the lower-most plane 33 to below the lower-most plane 33. As the chin strap 40 transitions from the deployed position toward the stowed position, at least a portion of the chin strap 40 again traverses the lower-most plane, with the twist adjustment mechanism passing from below the lower-most plane 33 to above the lower-most plane 33. When in the stored, position, the twist adjustment mechanism 44 resides above the lower-most plane 33, and between the forward most plane 31 and a rearward most plane defined by the rear portion 27 of the shell 21 and parallel to the forward most plane 31.

The chin strap assembly 40 may define a strap length as the distance along the chin strap 40 between the attachment points of the chin strap assembly 40 to the shell assembly 20, e.g., the length along the strap between the pivot ends 42*a*, 42*b*. The length may be selectively and incrementally adjustable to allow for selective loosening and tightening of the strap 40 as needed. For instance, the strap 40 may be loosened/lengthened to facilitate pivoting of the strap 40 between the stored and deployed positions.

Figure 6:
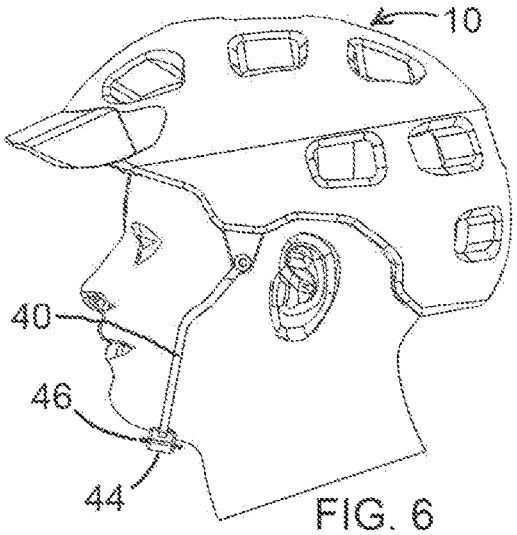
FIG. 6 is a side view of a pivoting retractable chin strap pivoted all the way down and retracted and ready for use in a helmet assembly shown in FIG. 1.
Figure 7:
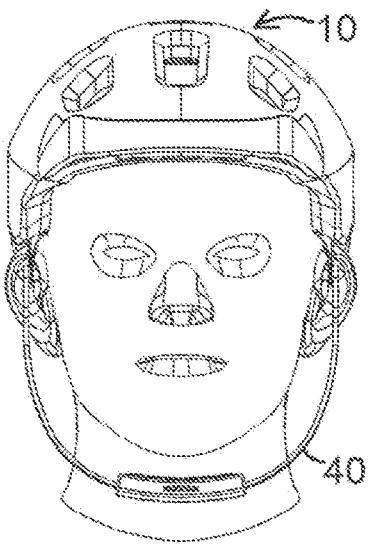
FIG. 7 is a front view of the helmet assembly shown in FIG. 5.
Figure 8:
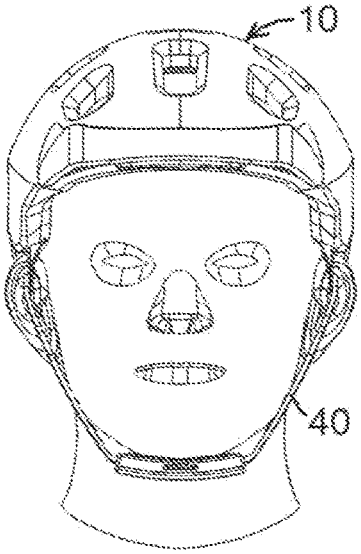
FIG. 8 is a front view of the helmet assembly shown in FIG. 6.
Figure 9:
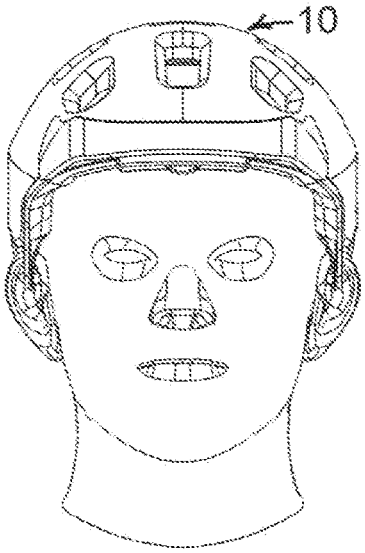
FIG. 9 is a front view of the helmet assembly shown in FIG. 1.
Figure 10:
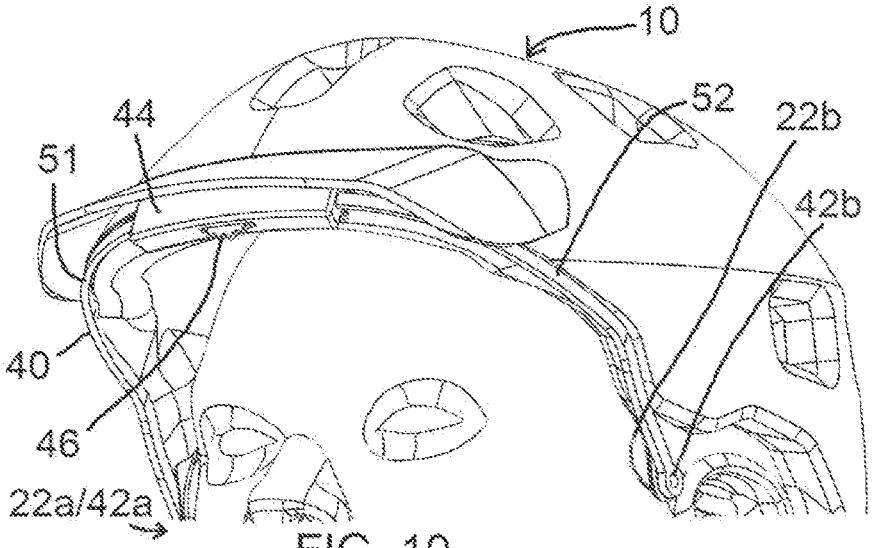
FIG. 10 is a perspective view of the helmet assembly shown in FIG. 1.

When the strap 40 is in the deployed position, the strap 40 may be tightened/shortened to secure the helmet 10 to the user's head. FIG. 6 shows chin strap assembly 40 having been retracted by the user in order to properly secure helmet 10 to the user's head. Note that one particular embodiment of the twist assembly 44 may allow for easy and quick retraction or extension using two fingers of one hand by rotating twisting knob 46. When retracted, helmet 10 may be secured to the user's head, with such size and positional adjustment of the strap assembly 40 having been made correctly, safely, and quickly. Note that chin strap assembly 40 mechanism 44 may lock for any particular adjustment length (e.g., selectively incrementally adjustable) via an internal locking mechanism, such as a gear.

Conventional helmet chin straps tend to be difficult to adjust properly such that most users wear helmets that are improperly adjusted and unsafe. Furthermore, when conventional chin strap fit is optimized for safety, comfort may be reduced, which may result in users being unwilling to use a helmet in a safe configuration for any length of time. In this way, helmet 10 may be safer because the chin strap is much easier to adjust correctly and may be loosened for uses of reduced danger.

According to one embodiment, chin strap 40 contour 47 fits closely to shell 20 contour 26 when the chin strap 40 is in the stored position in order to conceal the chin strap 40 as much as possible to provide the widest possible field of view to the user when chin strap 40 is stored away. In this regard, the shell 21 may include a lower edge having a specific contour that includes a first segment 35 and a second segment 37 angled relative to the first segment 35. Each first segment 35 may be positioned adjacent an attachment point of the chin strap 40 and the second segment 37 may extend from the first segment 35 to define an angle therebetween. The chin strap 40 may be similarly configured and include a pair of end portions 39 and a central portion 43, with each end portion 39 extending from the central portion 43 to define an angle therebetween. The angle defined by the chin strap 40 may be similar in shape and magnitude to the angle defined by the shell 21, such that when the chin strap 40 is in the retracted position, the end portions of the chin strap 40 may reside adjacent or against the first segment 35 of the shell lower edge, and at least some of the central portion 43 of the chin strap 40 may reside adjacent or against the second segment 37 of the shell lower edge.

Helmet 10 may also be configured to allow the user to easily loosen the chin strap 40 assembly when no danger is present (e.g., not participating in a risk-associated activity), and then tighten the chin strap 40 quickly and firmly using only one hand when about to proceed with a dangerous activity. For example, chin strap assembly 40 can be loosened while riding on a ski chair lift and then tightened again prior to skiing. Tightening the chin strap 40 can be easily facilitated with one hand, whereas conventional chin straps typically require two hands to buckle. Furthermore, conventional helmets usually require removal from the user's head in order adjust the tightness. As such, user's almost always wear conventional helmets with the chin strap too loose for safety.

Although not shown in figures, the helmet 10 may include an adjustable headband assembly that may encircle the wearer's head. The adjustable headband assembly may be similar to the adjustment mechanism described in U.S. Pat. No. 8,032,993 to Musal, the contents of which are expressly incorporated herein by reference. The adjustable headband assembly may be quickly and easily micro-adjusted with one hand. The headband assembly may not be included in all helmets, although it may be preferred for ease of adjustment, comfort, and safety for most activities where helmets are commonly worn, such as cycling, snowboarding and skiing, skateboarding, rock climbing, baseball, field hockey, ice hockey, horse riding, battle fields, and on construction sites, to name a few.

Figure 12:
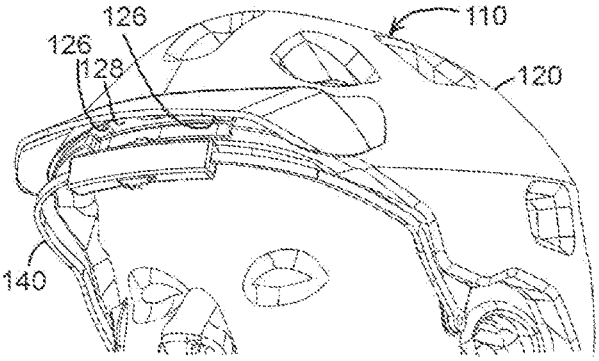
FIG. 12 is a perspective view of an alternative embodiment helmet assembly with a pivoting retractable chin strap slightly pivoted down from a stored position.
Figure 13:
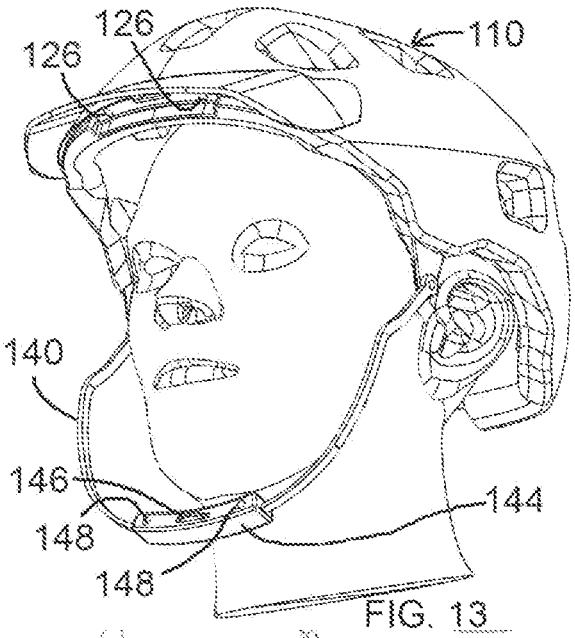
FIG. 13 is a perspective view of the helmet assembly shown in FIG. 12 with the pivoting retractable chin strap pivoted all the way down and ready for retraction.
Figure 14:
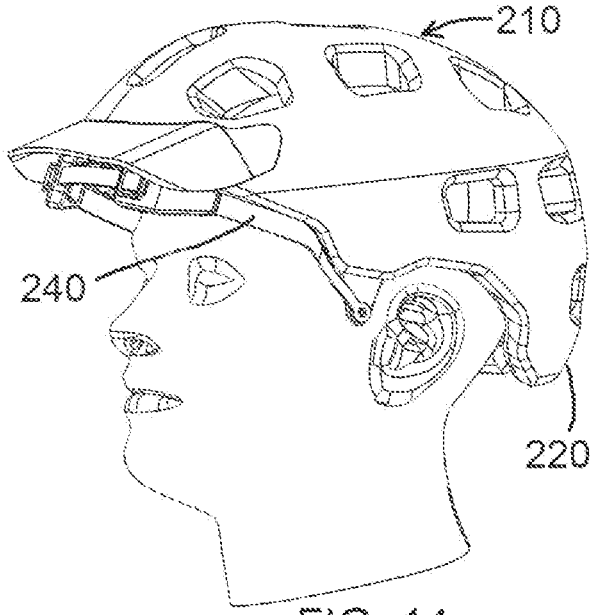
FIG. 14 is a perspective view of another alternative embodiment helmet assembly with a pivoting retractable chin strap in a stored position.
Figure 15:
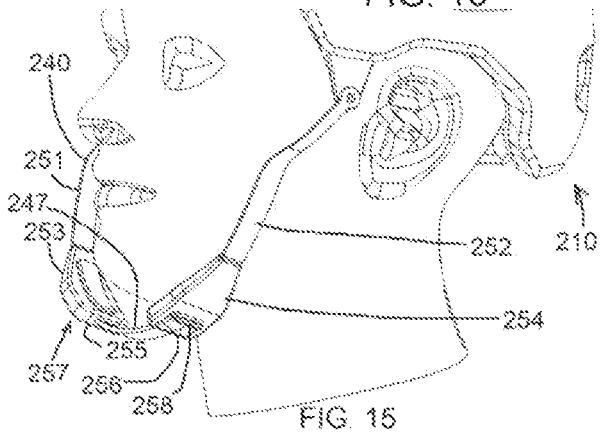
FIG. 15 is a perspective view of the helmet assembly shown in FIG. 14 with the pivoting retractable chin strap pivoted all the way down an ready for retraction.
Figure 16:
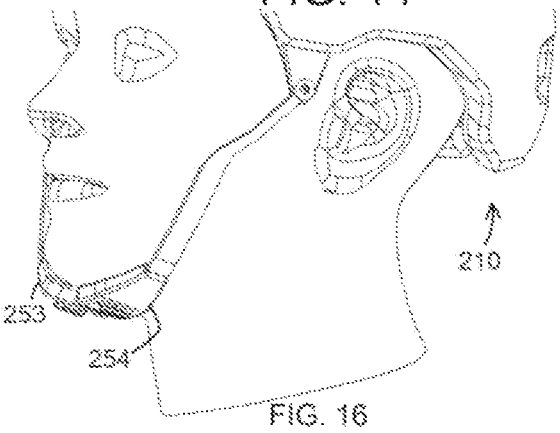
FIG. 16 is a perspective view of the helmet assembly shown in FIG. 14 with the pivoting retractable chin strap pivoted all the way down and retracted and ready for use.

As shown in FIGS. 12 and 13, helmet 110 is depicted as an alternative embodiment to helmet 10, with the primary distinction being that pivoting retractable chin strap assembly 140 may be magnetically held in its stored position. Shell 120 includes a pocket 128 having magnets 126 for magnetic connection to magnets 148, which may be located in or adjacent a twist mechanism 144 of chin strap assembly 140. The magnets 126, 148 may be sized and configured, such that as the chin strap 140 approaches the stored position, the magnetic attraction between the magnets 126, 148 is sufficient to retain the chin strap 14 in the stored position. To transition the chin strap 140 from the stored position toward the deployed position, a force is applied to the chin strap 140 sufficient to overcome the magnetic attraction, to allow the chin strap to continue toward the deployed position. While various means can be designed to help retain chin strap assembly 140 in its stored position, magnets may be convenient and simple. Examples of other means may include friction, ball detent, flex detent, and various locking systems.

Figure 26:
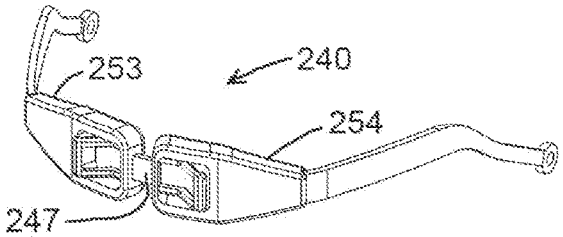
FIG. 26 is a perspective view of the pivoting retractable chin strap assembly retracted as shown in FIGS. 24-25 after retraction.
Figure 27:
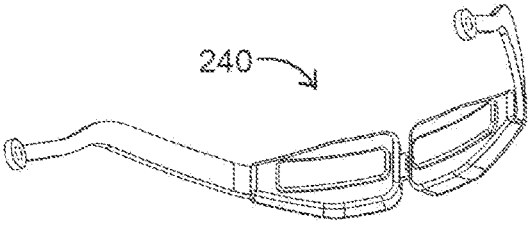
FIG. 27 is a perspective rear view of the pivoting retractable chin strap assembly retracted as shown in FIG. 26.

As shown in FIGS. 14-16 and 24-27, helmet assembly 210 is yet another embodiment that includes a different type of pivoting retractable chin strap assembly 240. Instead of a twist motion to retract and extend straps, chin strap assembly 240 is comprised of arms 251, 252, ratchet mechanisms 253, 254, connector strap 247, pads 241*a*, 241*b*, and buttons 257, 258. Connector strap 247 includes teeth 248 shown in FIG. 25 that engage with buttons 257, 258. Chin strap assembly 240 has pivots 242*a*, 242*b* for rotation of chin strap 240 between a stored position shown in FIG. 14 and a ready-under-the-chin position (e.g., a deployed position) shown in FIG. 15 without colliding with the user's face. After the user pivots chin strap assembly 240 to under their chin, with one hand, they can squeeze surface 255 towards surface 256 in order to retract chin strap assembly 240 into a safe and proper position. To tighten chin strap 240, the user squeezes surface 255 of mechanism 253 towards surface 256 of mechanism 254 and cause mechanisms 253 and 254 to become closer together as shown in FIGS. 26 and 27, effectively shortening chin strap 240. In order to loosen chin strap 240, the user can depress button 257 and/or 258, which will cause disengagement with teeth 248 of connector strap 247. Pads 241*a*, 241*b* may provide comfort for contact with the user's chin.

Figure 17:
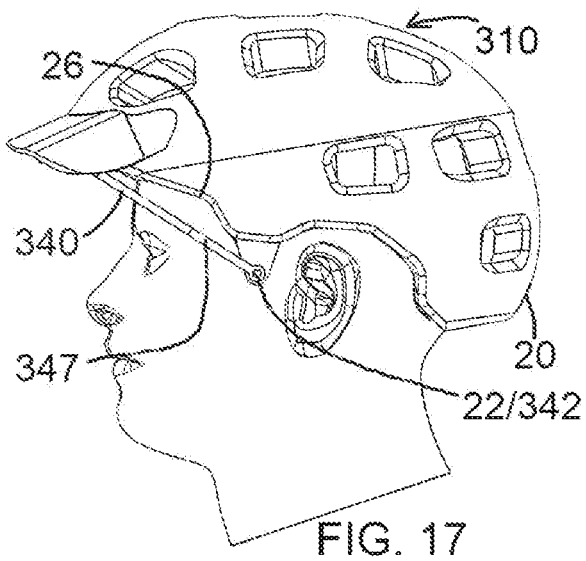
FIG. 17 is a side view of another alternative embodiment helmet assembly with a pivoting retractable chin strap in a stored position.
Figure 18:
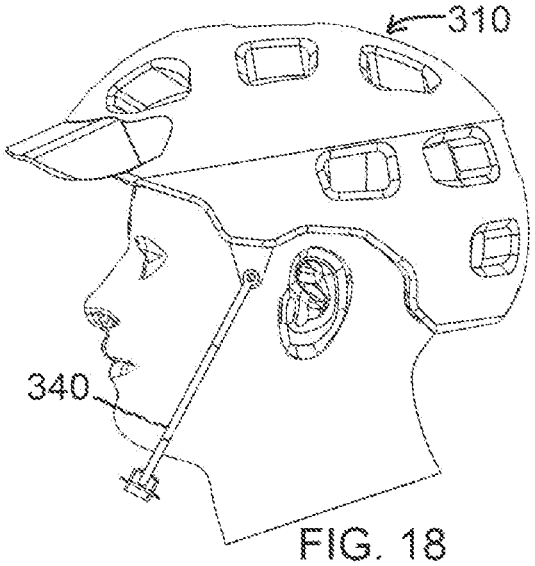
FIG. 18 is a side view of the helmet assembly shown in FIG. 17 with the pivoting retractable chin strap pivoted all the way down an ready for retraction.
Figure 19:
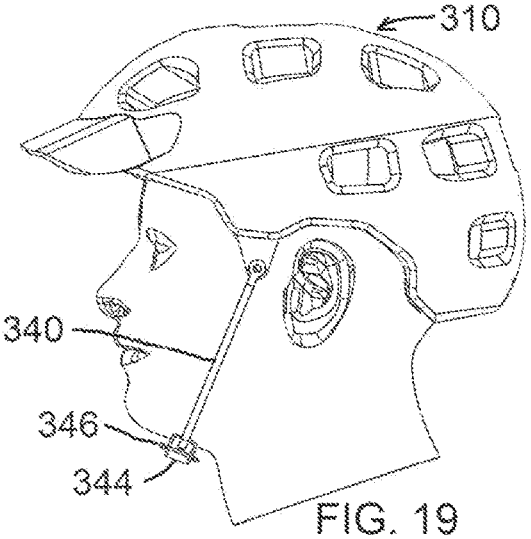
FIG. 19 is a side view of the helmet assembly shown in FIG. 17 with the pivoting retractable chin strap pivoted all the way down and retracted and ready for use.

As shown in FIGS. 17-19, helmet 310 is shown, which is similar to helmet 10 except that chin strap 340 has straight surface 347 instead of curved contour 47. Helmet 10 may have improved user visibility over embodiment 310, but embodiment 310 chin strap assembly 340 may have a stiffer pull strength because of its straighter contour 347.

Figure 20:
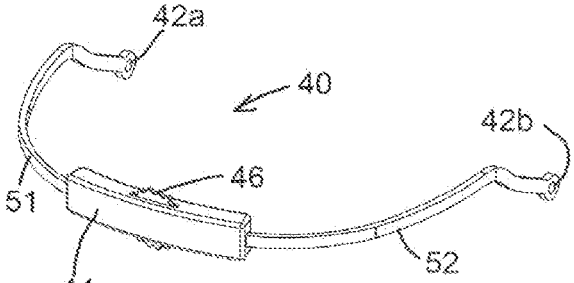
FIG. 20 is a perspective front view of the pivoting retractable chin strap assembly shown in FIGS. 1-11 before retraction.
Figure 21:
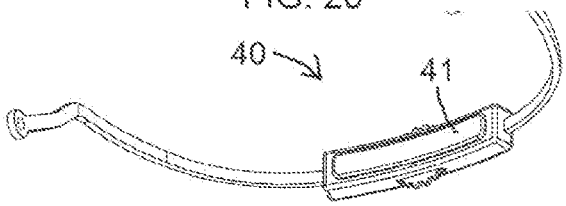
FIG. 21 is a perspective rear view of the pivoting retractable chin strap assembly shown in FIG. 20.

As shown in FIGS. 20 and 21, chin strap assembly 40 is comprised of arms 51 and 52 with pivots 42*a* and 42*b*. When twist knob 46 (e.g., dial) is turned in a first rotational direction, arms 51, 52 are moved in a first direction, e.g., away from each other and extending out of the mechanism 44 to effectively lengthen the total length of the chin strap assembly 40. When twist knob 46 is turned in an opposing second rotational direction, arms 51, 52 are moved in a second direction, e.g., drawn toward each other and into mechanism 44, effectively shortening the total length of chin strap assembly 40. There is a pad 41 for comfort for contact with the user's chin.

Figure 22:
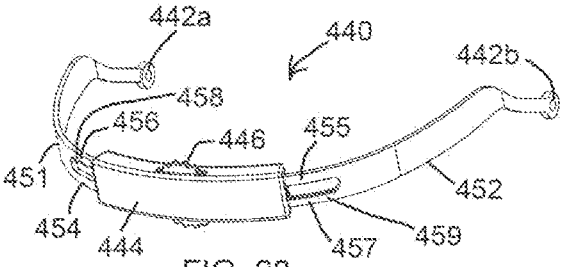
FIG. 22 is a perspective front view of an alternative embodiment pivoting retractable chin strap assembly before retraction.
Figure 23:
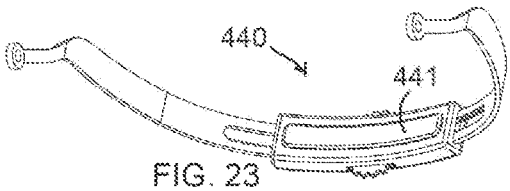
FIG. 23 is a perspective rear view of the pivoting retractable chin strap assembly shown in FIG. 22.
Figure 24:
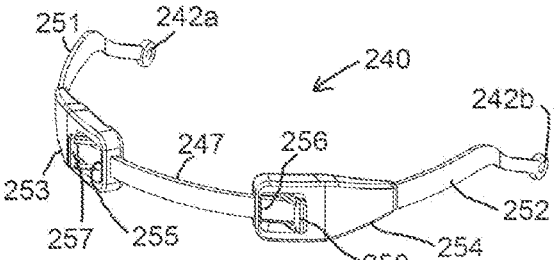
FIG. 24 is a perspective front view of the pivoting retractable chin strap assembly shown in FIGS. 14-16 before retraction.
Figure 25:
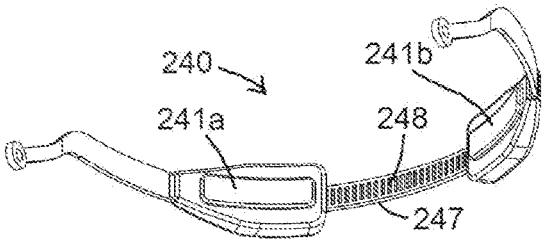
FIG. 25 is a perspective rear view of the pivoting retractable chin strap assembly shown in FIG. 24.

As shown in FIGS. 22 and 23, chin strap assembly 440 is a variation of chin strap 40 and is comprised of arms 451, 452 with pivots 442*a*, 442*b*. Arm 451 has two legs 454, 458 separated by a channel, wherein leg 458 has gear teeth 456. Arm 452 has two legs 455, 459 separated by a channel, wherein leg 459 has gear teeth 457. When twist knob 446 on housing 444 is turned, legs 454, 455, 456, 457 are drawn into housing 444, effectively shortening the total length of chin strap assembly 440. Pad 441 may be included to provide comfort for contact with the user's chin.

Figure 28:
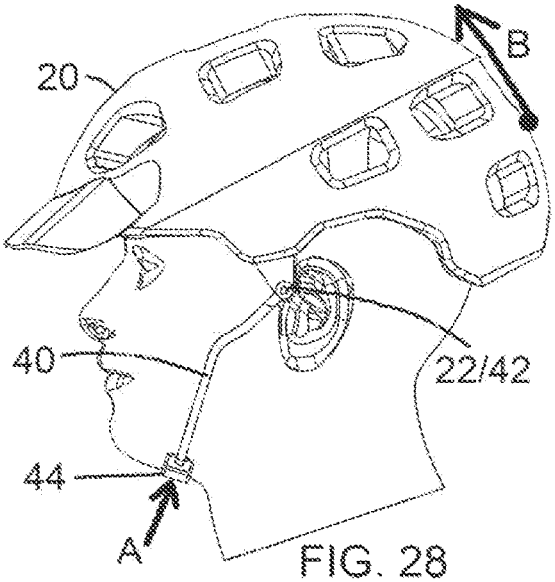
FIG. 28 is a side view of the helmet assembly shown in FIGS. 1-11 and with a strong force pulling the rear of the helmet up and forward as per certain industry testing standards.
Figure 29:
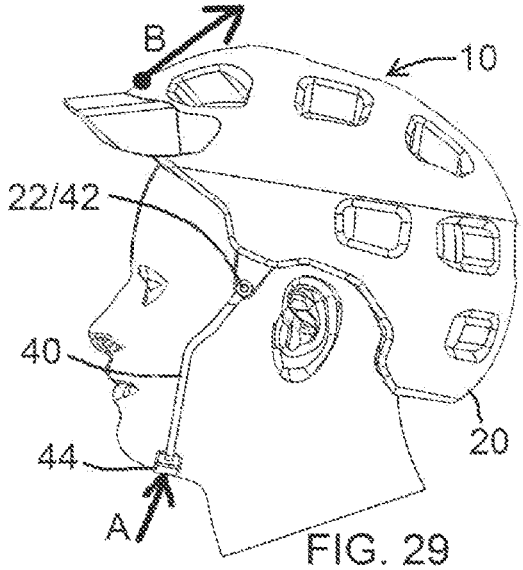
FIG. 29 is a side view of the helmet assembly shown in FIG. 28 and with a strong force pulling the front of the helmet up and rearward as per certain industry testing standards.

As shown in FIGS. 28 and 29, when forces are applied to pull the helmet in the direction "B", the bottom of chin strap 40, e.g., twist mechanism 44, is pulled into the users chin in direction "A", resisting this motion. FIGS. 28 and 29 are shown exaggerated for clarity but helmet 10 would likely not be able to move as far as depicted when chin strap 40 is properly adjusted. There is a test standard for bicycle helmets that applies loads as shown in order to determine whether the strap system can adequately secure helmet on the user's head. As previously mentioned, prior art strap systems are notoriously difficult to adjust properly and one of the consequences of this is that in real use, the helmet can easily move out of its protective optimal position when forces are applied as shown here. However, in accordance with various aspects of the present disclosure, pivoting retractable chin strap assembly 40, 140, 240, 340, 640, 740 secures helmet embodiment 10, 110, 210, 310, 510, 610, 710 in position.

A significant feature of helmet 10 which aids in withstanding forces in the direction of "B" is that the location of pivot 22, 42 causes chin strap 40 mechanism 44 to move in direction "A" regardless of whether helmet 10 is pulled forwards and upwards as shown in FIG. 28 or pulled backwards and upwards as shown in FIG. 29. For this to happen, pivot 22, 42 may be low enough to move backwards towards user's ear when the helmet is pulled in the manner depicted in FIG. 28 and pivot 22, 42 may move forwards towards user's nose when the helmet is pulled in the manner depicted in FIG. 29. In that way, chin strap 40 may become tighter to the user's chin and will resist helmet 10, 110, 210, 310, 510, 610, 710 from dislodging as in FIGS. 28 and 29.

Figure 30:
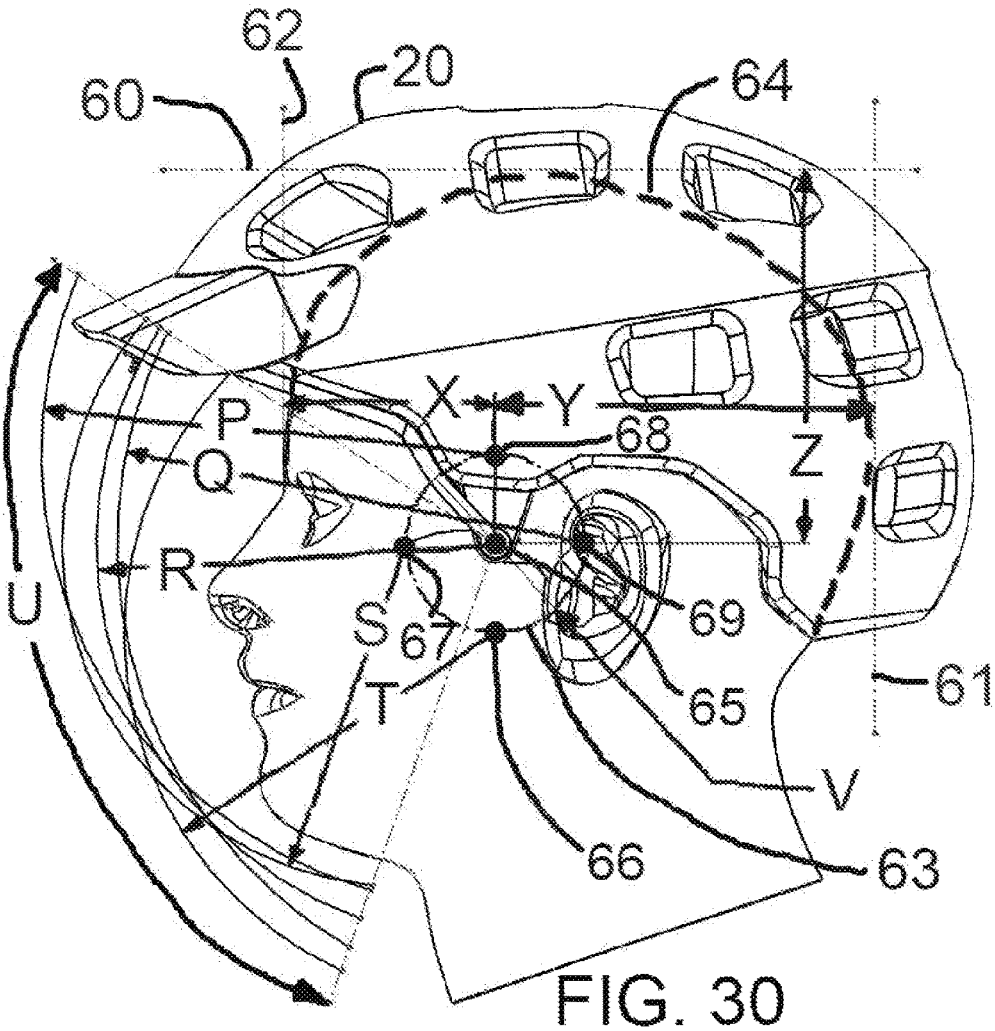
FIG. 30 is a side view of the helmet assembly shown in FIGS. 1-11 showing the location zone of preferred pivot rotation.
Figure 31:
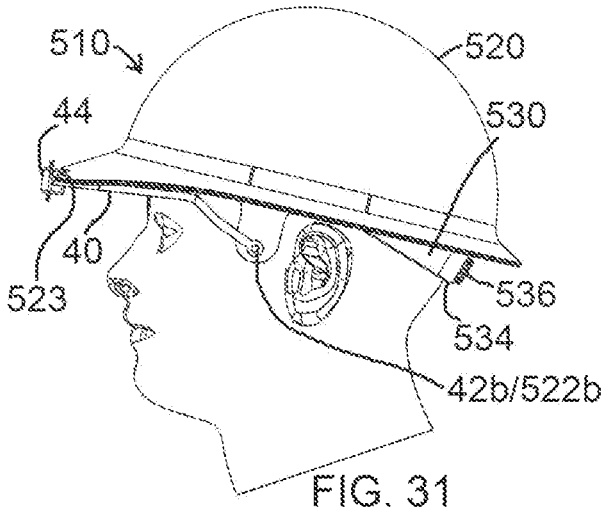
FIG. 31 is a side view of an alternative embodiment helmet assembly with a pivoting retractable chin strap in a stored position in a helmet assembly worn by a user.
Figure 32:
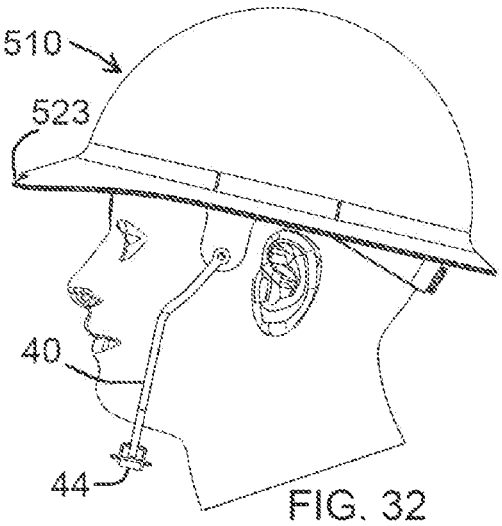
FIG. 32 is a side view of a pivoting retractable chin strap pivoted all the way down and ready for retraction in a helmet assembly shown in FIG. 31.
Figure 33:
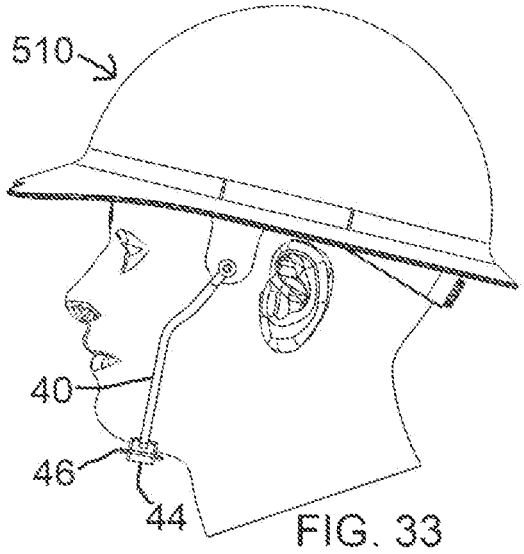
FIG. 33 is a side view of a pivoting retractable chin strap pivoted all the way down and retracted and ready for use in a helmet assembly shown in FIG. 31.
Figure 34:
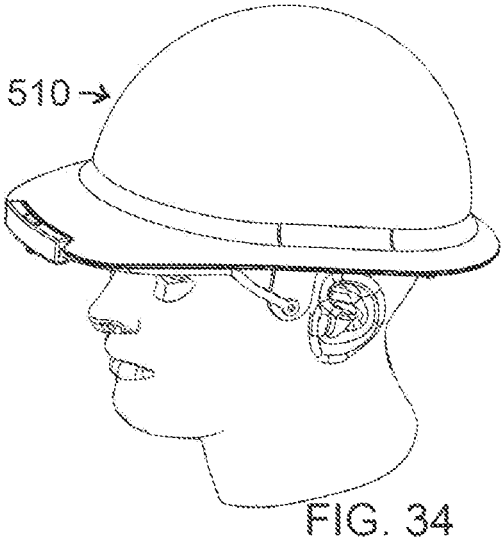
FIG. 34 is a perspective view of the alternative embodiment helmet assembly shown in FIG. 31.

As shown in FIG. 30, a chin strap pivot location zone 63 is a limited size in order to ideally achieve four objectives. A first objective is that when pivoting from stored position to under-the-chin position, the mechanism 44 of chin strap assembly 40 should ideally not collide with the user's nose, chin, or other facial features. A second objective is that mechanism 44 of chin strap assembly 40 is ideally a reasonable distance beneath the user's chin prior to retraction in order for the retraction process to be reasonable for the user. If the distance is too great, then the retraction process is inconvenient. A third objective is that mechanism 44 of chin strap 40 is ideally beyond the user's forehead and out of sight line while still a reasonable distance in front of the helmet. At some point, mechanism 44 may be so far in front of shell 20 as to be unsightly and causing the helmet to be less compact. With regard to the fourth objective, as shown in FIGS. 28 and 29, pivot 42*a*, 42*b* may cause mechanism 44 to pull into the user's chin in generally direction "A" when shell 20 is pulled generally in direction "B". If pivot 42*a*, 42*b* is too far forward or too high, then pulling shell 20 in direction "B" of FIG. 28 may not cause mechanism 44 to pull upwards into the user's chin in direction "A" and would allow shell 20 to dislodge from the user's head. If pivot 42*a*,

42*b* is too far backward or too high, then pulling shell 20 in direction "B" of FIG. 29 would not cause mechanism 44 to pull upwards into the user's chin in direction "A" and would allow shell 20 to dislodge from the user's head.

Therefore, according to at least one embodiment, chin strap assembly pivot zone 63 comprises all of the pivot locations where the chin strap 40 can pivot from while satisfying the aforementioned ideal objectives. The helmet assembly 10 may be sized and configured such that the pivot zone 63 may overlap a portion of the shell 20.

Chin strap assembly 40 may pivot through a range "U" between its stored position and useable position under the user's chin. Angle "U" may be between about 70 and 140 degrees, depending on the pivot location. Angle "U", as shown, refers to the arc with radius "R" at center point 65, which is at the center of the chin strap pivot location zone 63. The center point 65 is located a distance X behind a helmet forehead support location 62, a distance Y in front of the helmet back of a head support location 61, and a distance Z below the helmet top of the head support location 60. The helmet forehead support location 62 may be a forward-most point on the inner surface of the shell 21, which resides on a forward plane. The helmet back of the head support location 61 may be a rear-ward most point on the inner surface of the shell 21, which resides on a rear plane parallel to the forward plane. The helmet top of the head support location 60 may be an upper-most point residing on an upper plane perpendicular to both the forward and rear planes. In one particular implementation, Y=Z, and X is about 36% of the distance between the front and back of the supports for the user's head, or X~=0.56Y. The diameter "V" of chin strap pivot location zone 63 may be 85% of distance X, or diameter V=0.85X. For example, for a typical large helmet for an adult male user, X=76 mm, Y=135 mm, Z=135 mm, and diameter "V"=65 mm.

As examples, FIG. 30 shows arcs with center points at extreme locations around chin strap pivot location zone 63. Specifically radius "T" has a center point 66 located at the bottom of pivot zone 63, radius "R" has a center point 67 located at the forward most point of pivot zone 63, radius "P" has a center point 68 located at the top of pivot zone 63, and radius "Q" has a center point 69 located at the rearward most point of pivot zone 63. The chin strap radii vary depending on the center point chosen for the chin strap pivot. For example, for a large helmet for an adult male user, radius "R" may be about 140 mm, radius P may be about 165 mm, radius Q may be about 170 mm, radius "S" may be about 125 mm, and radius "T" may be about 135 mm. These are the approximate radii from the pivot point 65, 66, 67, 68, 69 to the inner side of mechanism 44.

As shown in FIGS. 31-34, a construction hard hat 510 is comprised of a shell assembly 520, chin strap assembly 40, and a headband assembly 530. Headband assembly 530 has an adjustment mechanism 534 and a twist knob 536. Headband assembly 530 can be quickly and easily micro-adjusted with one hand and locked in position. The general function of helmet 510 is similar to helmet 10 in that chin strap assembly 40 has a stored position and can be pivoted down around pivot 522*b* to be under the user's chin and then mechanism 44 can be quickly adjusted by twist knob 46 to be snug against the user's chin in order to properly secure helmet 510 on the user's head. In construction applications, there may be many times when wearing a chin strap may not be necessary and thus, it may be especially convenient to be able to wear the hard hat with the chin strap either loose or in the stored position. Then, when necessary, such as when working high up on a building or in windy conditions, the user can quickly and easily deploy and adjust their chin strap 40. Helmet 510 has a recess 523 of shell 520 for mechanism 44 to store within.

Figure 35:
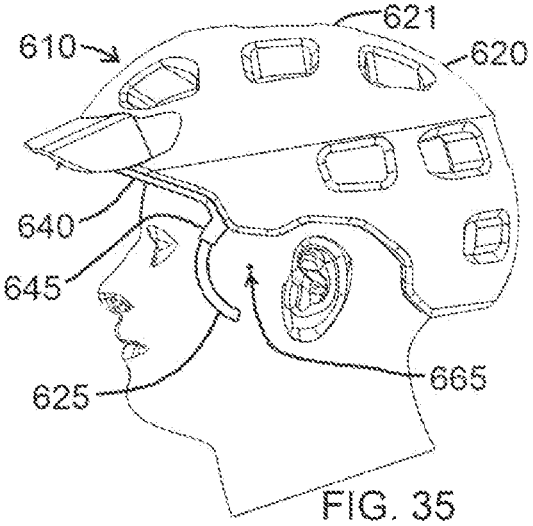
FIG. 35 is a side view of an another alternative embodiment helmet assembly with pivoting retractable chin strap in a stored position in a helmet assembly worn by a user.
Figure 36:
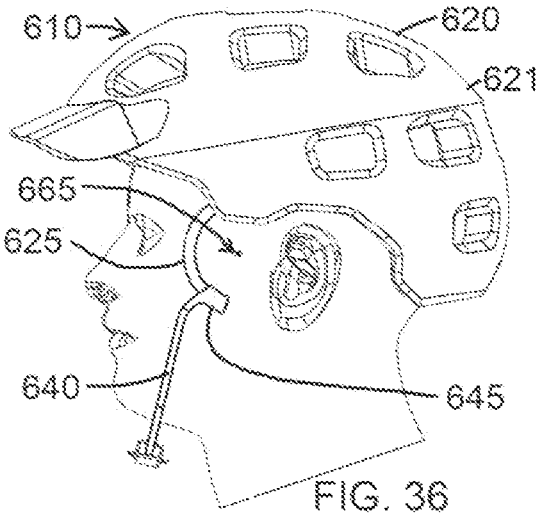
FIG. 36 is a side view of a pivoting retractable chin strap pivoted all the way down and ready for retraction in a helmet assembly shown in FIG. 35.

As shown in FIGS. 35 and 36, helmet 610 demonstrates using a virtual pivot point 665. Helmet 610 is comprised of a shell assembly 620 having a curved guide 625 extending downwardly from shell 621 and operatively connected to a follower 645 included on chin strap assembly 640. In particular, the curved guide 625 and follower 645 are configured such that the follower 645 slides along the curved guide 625 as the chin strap assembly 640 transitions between the stored positioned and the deployed position. In this way, although the follower 645 may translate or slide along the curved guide 625, the chin strap assembly 640 pivots about virtual pivot point 665 between stored position shown in FIG. 35 and ready-under-the-chin position shown in FIG. 36. Virtual pivot point 665 could be ideally anywhere within pivot zone 63 shown in FIG. 30. It is contemplated that curved guide 625 may be curved in a non-circular manner which may result in a virtual pivot zone instead of virtual pivot point 665.

Figure 37:
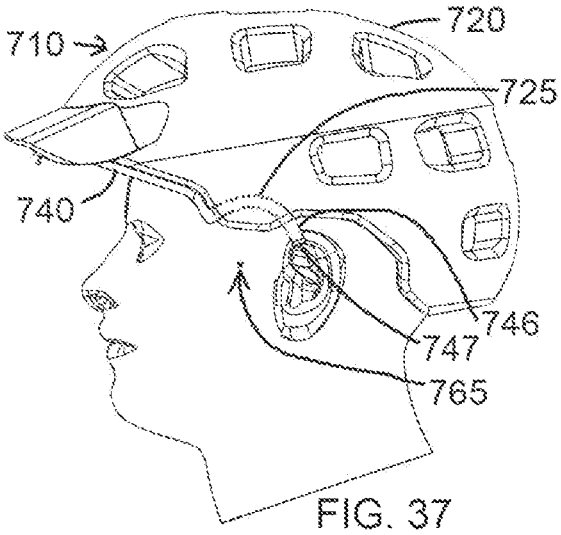
FIG. 37 is a side view of an alternative embodiment helmet assembly with pivoting retractable chin strap in a stored position in a helmet assembly worn by a user.
Figure 38:
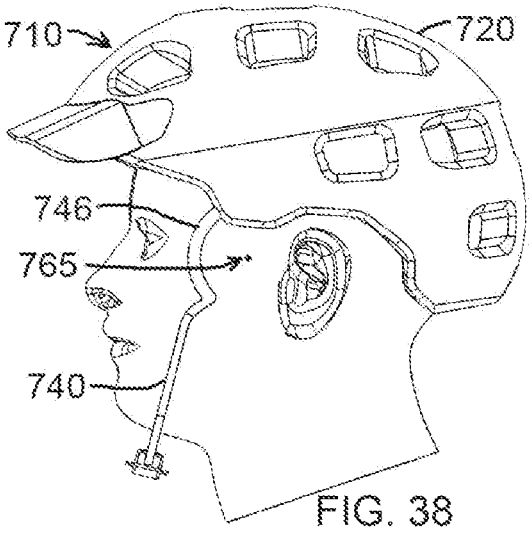
FIG. 38 is a side view of a pivoting retractable chin strap pivoted all the way down and ready for retraction in a helmet assembly shown in FIG. 37.
Figure 39:
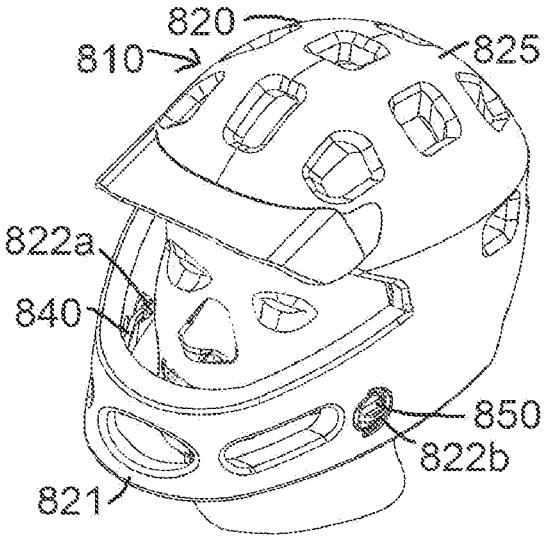
FIG. 39 is a perspective view of another embodiment helmet assembly with pivoting retractable chin strap in a stored position in a helmet assembly worn by a user.
Figure 40:
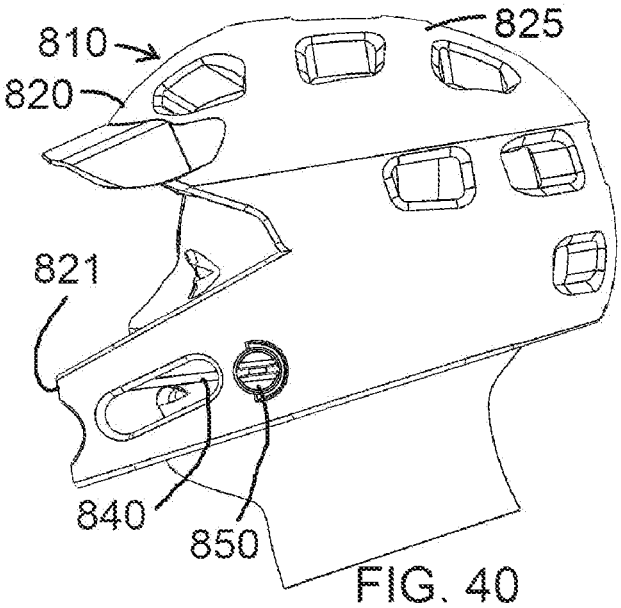
FIG. 40 is a side view of the alternative embodiment helmet assembly shown in FIG. 39.
Figure 41:
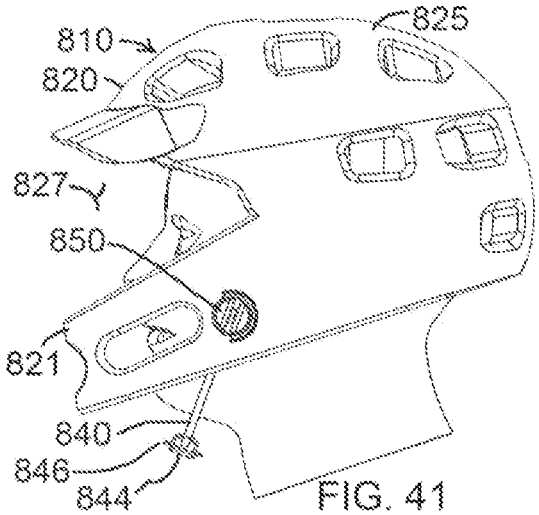
FIG. 41 is a side view of the embodiment helmet assembly shown in FIG. 39 with the pivoting retractable chin strap pivoted all the way down and ready for retraction.

As shown in FIGS. 37 and 38, helmet 710 demonstrates using a virtual pivot point 765. Helmet 710 is comprised of a shell assembly 720 having a curved guide slot 725 shown hidden in dashed lines in FIG. 37 that chin strap assembly 740 follower 746 slides through. There is a stop rib 747 that prevents follower 746 from sliding all the way out of guide slot 725. In this way, chin strap 740 pivots about virtual pivot point 765 between stored and ready-under-the-chin positions.

Figure 42:
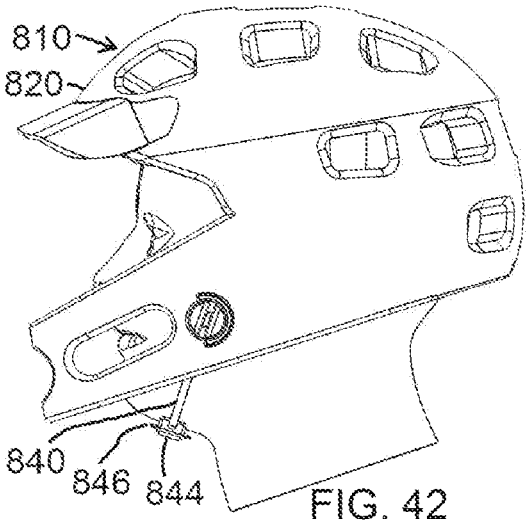
FIG. 42 is a side view of the embodiment helmet assembly shown in FIG. 41 with the pivoting retractable chin strap retracted and worn by a user.
Figure 43:
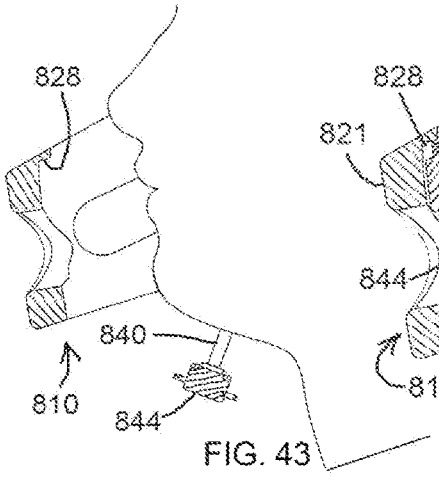
FIG. 43 is a sectional side view of the embodiment helmet assembly shown in FIG. 41.
Figure 44:
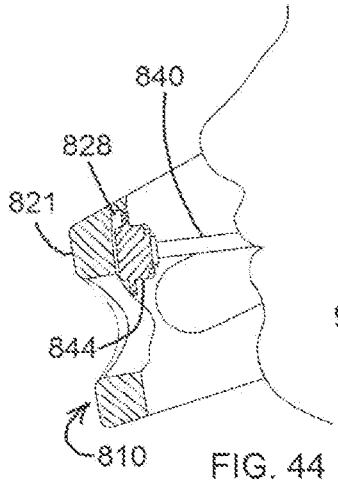
FIG. 44 is a sectional side view of the embodiment helmet assembly shown in FIG. 40.

As shown in FIGS. 39-44, helmet 810 is a full-face helmet comprising a shell assembly 820, a chin strap assembly 840, and a knob 850 on the outside of shell assembly 820 and in operative communication with the chin strap assembly 840. Shell assembly 820 has a mouth guard 821 in spaced relation to an upper portion 825 to define an opening 827 therebetween to allow a user to see through the helmet 810. The mouth guard 821 may extend from opposed sides of the helmet 810 in front of the user's mouth to offer enhanced protection to the user's face. Chin strap assembly 840 transitions about pivots 822*a*, 822*b* between a stored position shown in FIGS. 39-40, and 44 and the deployed, under the chin position shown in FIGS. 41 and 43. In embodiments including a mouth guard 821, the chin strap assembly 840 may become aligned with the mount guard 821 when in the stored position, and extend below the mouth guard 821 when in the deployed position. By twisting knob 850, the user can move chin strap assembly 840 from the stored position to the deployed position. Knob 850 may not be required but may be convenient in a full-face helmet for ease of pivoting chin strap assembly 840. Twisting knob 846 on mechanism 844 may lengthen or shorten chin strap assembly 840. FIG. 42 shows chin strap assembly 840 tightened to the user's chin. It is noted that pivots 822*a*, 822*b* may be located to allow chin strap 840 to be stored in a position that clears the user's face when putting helmet 810 on or taking helmet 810 off of user's head, and also without obstructing user's vision. While not required, there is a pocket recess 828 that mechanism 844 fits within when stored. Various means or mechanisms could be used to reliably keep chin strap 840 in its stored position such as friction, magnets, ball detent, flex detent, and others.

There may be more freedom for the location of pivots 822*a*, 822*b* than on non-full-face helmets because a full-face helmet may not be able to move up/forward as shown in FIG. 28 because of the way that the full-face helmet's shell assembly 820 surrounds the user's head. Therefore, pivot

822*a*, 822*b* may not need to be in a location that causes chin strap assembly 840 to become tighter when a force B (shown in FIG. 28) is applied to helmet 810. However, chin strap assembly 840 must prevent helmet 810 from moving as shown in FIG. 29. Therefore, locations for pivot 822*a*, 822*b* need to ideally achieve the following objectives. The first objective is that when pivoting from a stored position to an under the chin position, chin strap assembly 840 mechanism 844 may not collide with the user's nose, chin, or other facial feature. A second objective is that mechanism 844 of chin strap assembly 840 may be a reasonable distance beneath the chin prior to retraction in order for the retraction process to be reasonable for the user. If the distance is too great, then the retraction process may be inconvenient. A third objective is that mechanism 844 of chin strap assembly 840 may be beyond the user's nose and out of a user's sight line while still being within a mouth guard 821 of shell assembly 820. A fourth objective is that pivot 822*a*, 822*b* may cause mechanism 844 to pull into the user's chin in generally direction "A" when shell 820 is pulled generally in direction "B" shown in FIG. 29.

Figure 46:
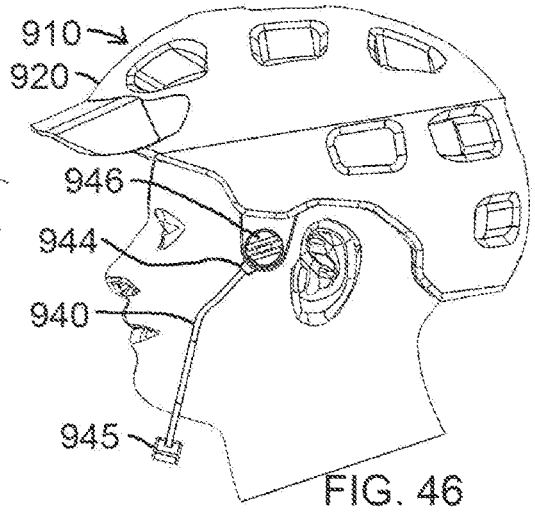
FIG. 46 is side view of the embodiment helmet assembly shown in FIG. 45 with the pivoting retractable chin strap pivoted all the way down an ready for retraction.
Figure 45:
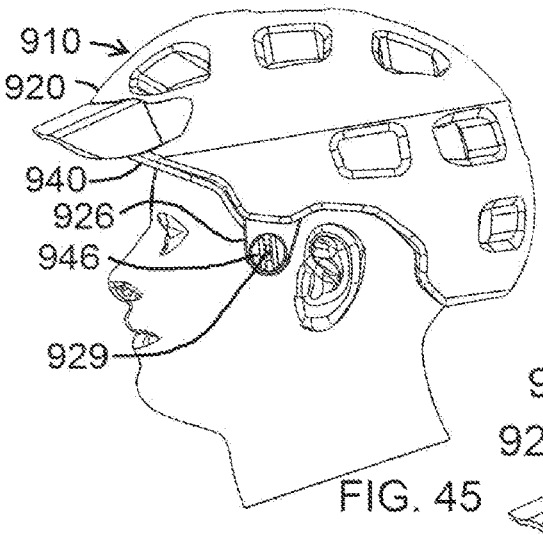
FIG. 45 is a side view of an alternative embodiment helmet assembly with a pivoting retractable chin strap in a stored position in a helmet assembly worn by a user.
Figure 47:
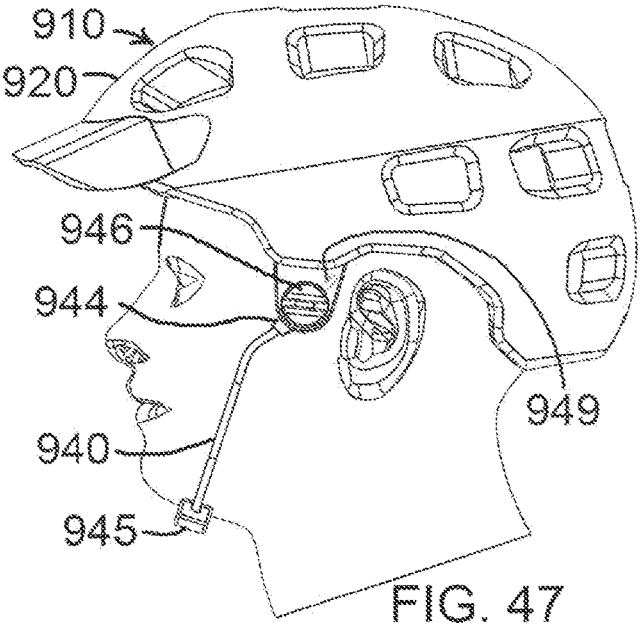
FIG. 47 is a side view of the alternative embodiment helmet assembly shown in FIG. 45 with the chin strap retracted.

As shown in FIGS. 45-47, helmet 910 is comprised of a shell assembly 920 with a support 926 on each side, and a chin strap assembly 940. Helmet 910 differs from all the other embodiments in that chin strap 940 may not include an adjustment mechanism in the user's chin area. Instead, chin strap assembly 940 may include mechanism(s) 944 on the side of the helmet. There may be a mechanism 944 on both sides of the helmet, or on only one side. As shown, chin strap assembly strap 940 pivots about point 929 and mechanism 944 may be located on pivot point 929. When twist knob 946 is turned, strap end 949 shown in dashed lines in FIG. 47 is pulled through mechanism 944 and chin strap assembly 940 is shortened which tightens chin strap assembly 940 to user's chin.

As shown, mechanism 944 is located on pivot 929 but could be located anywhere between pivot 944 and chin liner 945. Chin liner 945 slides along chin strap 940 and is not essential, but adds comfort.

While mechanism 944 is a twist mechanism, various other types of adjustment mechanisms known in the prior art are feasible such as a ratchet system similar to the mechanism shown in FIGS. 24-27.

The helmet embodiments shown in the figures are helmets typically used for bicycling, construction, and motorcycles. However, it should become obvious from these teachings how a pivoting adjustable chin strap could be applied to helmets for many other helmets such as for snowboarding and skiing, skateboarding, rock climbing, football, baseball, field hockey, ice hockey, horse riding, scooter riding, battlefields, etc. While the chin strap pivots shown are simple rotational pivots, there are other ways to accomplish the required movement of the chin strap in order to store in the desired location, not collide with the user's face during movement between the stored position and under the user's chin position, and cause retraction when the helmet is pulled forward/up and rearward/up. One solution would be a linkage mechanism such as a 4-bar linkage.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

The invention claimed is:

1. A helmet configured to be wearable on a head of a user, the helmet comprising:

a shell having a front portion, a crown portion, and a rear portion, an inner surface defining a cavity sized to receive at least a portion of the head of the user, the inner surface having a forward-most point residing on a forward plane, a rearward-most point residing on a rear plane parallel to the forward plane, and an uppermost point residing on an upper plane perpendicular to both the forward and rear planes, the shell further having a pair of opposed attachment zones, each attachment zone having a center point, the center point being a first distance from the forward plane, the center point being a second distance from the rear plane, and the center point being a third distance from the upper plane, the first distance being 50-60% of the second distance, and the second distance being equal to the third distance, each attachment zone being circular and having a diameter that is 80-90% of the first distance; and a chin strap having a first attachment body and a second attachment body defining a strap length therebetween, the chin strap being configured to allow for selective adjustment of the strap length, the first attachment body and the second attachment body each being connected to the shell within respective ones of the pair of opposed attachment zones.

2. The helmet recited in claim 1, wherein the chin strap is formed from a bendable material capable of being disposable in compression.

3. The helmet recited in claim 1, wherein the shell and chin strap are configured to define a continuous loop which remains intact while the shell is placed on the user's head.

4. The helmet recited in claim 1, wherein the chin strap is pivotally connected to the shell.

5. The helmet recited in claim 1, wherein the chin strap includes a pair of end portions and a central portion, each end portion being angled relative to the central portion.

6. The helmet recited in claim 1, wherein the shell includes a lower edge, at least a portion of which defines a contour that is complementary in shape to a contour of the chin strap.

7. The helmet recited in claim 1, wherein the chin strap includes a pair of arms, the pair of arms being moveable in a first direction away from each other to increase the strap length, and in an opposing second direction toward each other to decrease the strap length.

8. The helmet recited in claim 1, wherein at least a portion of the attachment zone overlaps the shell.

9. A helmet configured to be wearable on a head of a user, the helmet comprising:

a shell having a front portion, a crown portion, and a rear portion, an inner surface defining a cavity sized to receive at least a portion of the head of the user, the inner surface having a forward-most point residing on a forward plane, a rearward-most point residing on a rear plane parallel to the forward plane, and an uppermost point residing on an upper plane perpendicular to both the forward and rear planes, the shell further having a pair of opposed attachment zones, each attachment zone having a center point, the center point being a first distance from the forward plane, the center point being a second distance from the rear plane, and the center point being a third distance from the upper plane, the first distance being 50-60% of the second distance, and the second distance being equal to the third distance, each attachment zone being circular and having a diameter that is 80-90% of the first distance;

a chin strap having a first attachment body and a second attachment body defining a strap length therebetween, the chin strap being configured to allow for selective adjustment of the strap length, the first attachment body and the second attachment body each being connected to the shell within respective ones of the pair of opposed attachment zones; and a dial in operative communication with the pair of arms, the dial being rotatable relative to the pair of arms such that rotation of the dial in a first rotational direction allows the pair of arms to move away from each other, and rotation of the dial in a second rotational direction allows the pair of arms to move toward each other.

10. The helmet recited in claim 9, wherein each of the pair of arms includes teeth that interface with the dial.

11. A helmet configured to be wearable on a head of a user, the helmet comprising:

a shell having a front portion, a crown portion, and a rear portion, and a lower edge spaced from the crown portion and extending from the front portion to the rear portion, the shell further having a pair of opposed attachment zones, each attachment zone having a center point positioned below the lower edge; and a chin strap having a first attachment body and a second attachment body defining a strap length therebetween, the chin strap being configured to allow for selective adjustment of the strap length, the first attachment body and the second attachment body each being pivotally connected to the shell within respective ones of the pair of opposed attachment zones;

a pair of arms coupled to respective ones of the first and second attachment bodies; and a dial in operative communication with the pair of arms, the dial being rotatable relative to the pair of arms such that rotation of the dial in a first rotational direction allows the pair of arms to move away from each other, and rotation of the dial in a second rotational direction allows the pair of arms to move toward each other.

12. The helmet recited in claim 11, wherein the chin strap is formed from a bendable material capable of being disposable in compression.

13. The helmet recited in claim 11, wherein the shell and chin strap are configured to define a continuous loop which remains intact while the shell is placed on the user's head.

14. The helmet recited in claim 11, wherein at least a portion of the attachment zone overlaps the shell.

* * * * *